US005159392A

United States Patent [19]

Kasahara et al.

[11] Patent Number: 5,159,392

[45] Date of Patent: Oct. 27, 1992

[54] IMAGE FORMING APPARATUS FOR FORMING AN IMAGE ON ONE OR BOTH SIDES OF A RECORDING MEDIUM

[75] Inventors: Nobuo Kasahara, Yokohama; Yasunori Kawaishi, Narashino; Tatsuo Hirono, Kawasaki, all of Japan

[73] Assignee: Ricoh Company, Ltd., Tokyo, Japan

[21] Appl. No.: 689,525

[22] Filed: Apr. 23, 1991

[30] Foreign Application Priority Data

| | | | |
|---|---|---|---|
| Apr. 23, 1990 | [JP] | Japan | 2-107131 |
| Jun. 12, 1990 | [JP] | Japan | 2-152953 |
| Feb. 15, 1991 | [JP] | Japan | 3-44328 |

[51] Int. Cl.[5] ..... G03G 15/16

[52] U.S. Cl. ..... 355/274; 355/275; 355/319; 355/326

[58] Field of Search ..... 355/217, 219, 221, 271, 355/272, 273, 274, 326, 327, 319, 275

[56] References Cited

U.S. PATENT DOCUMENTS

| | | | |
|---|---|---|---|
| 3,671,118 | 6/1972 | Fantuzzo et al. | 355/319 |
| 3,697,170 | 10/1972 | Bhagat et al. | 355/274 |
| 4,714,939 | 12/1987 | Ahern et al. | 355/275 |
| 4,987,428 | 1/1991 | Bannai et al. | 355/326 X |
| 5,010,370 | 4/1991 | Araya et al. | 355/274 |
| 5,027,159 | 6/1991 | Oda et al. | 355/271 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

An image forming apparatus for forming an image on one or both sides of a recording medium includes a rotatable photoconductive element on which latent images are optically written, a developer which develops the images to produce a primary toner image on the photoconductive element, a belt which faces the photoconductive element, and onto which the toner image is transferred when a paper sheet is not present. A charged roller is close to and above an upper portion of the belt and downstream from the photoconductive element. The charged roller holds the paper on the belt and also transfers toner onto the underside of the paper.

27 Claims, 15 Drawing Sheets

IMAGE FORMING APPARATUS FOR FORMING AN IMAGE ON ONE OR BOTH SIDES OF A RECORDING MEDIUM

BACKGROUND OF THE INVENTION

The present invention relates to an image forming apparatus which enhances efficient transfer of a toner image to a transfer belt or similar transferring medium and a paper sheet or similar recording medium.

It is a common practice with a copier, printer or similar image forming apparatus to electrostatically form a latent image representative of a document image on a photoconductive element, develop the latent image to produce a toner image, and then electrostatically transfer the toner image to a recording medium such as a paper sheet. This kind of image forming process is executed in a one-sided front copy mode which transfers the toner image from the photoconductive element to the paper sheet or similar recording medium directly. Another image forming process available with an image forming apparatus uses a transfer belt or similar transferring medium located in close proximity to the photoconductive element. In this case, the toner image is once transferred to the transferring medium in matching relation to a record mode selected. Such a process is executed in a one-sided rear copy mode or in a two-sided copy mode. Specifically, in the one-sided rear copy mode, the toner image formed on the photoconductive element, i.e., a primary toner image is once transferred to the transfer belt by primary toner image transfer means, and then the toner image on the transfer belt, i.e., a secondary toner image is transferred to the rear surface of a paper sheet which is fed to the transfer belt. In the two-sided copy mode, a primary toner image formed on the photoconductive element first is transferred to the transfer belt as a secondary toner image, while a toner image is formed again on the photoconductive element. Subsequently, the secondary toner image on the transfer belt and the second toner image on the photoconductive element are transferred to a paper sheet at the same time by second toner image transfer means and first toner image transfer means, respectively. Such a scheme makes it needless to turn over the paper sheet in the two-sided copy mode and is disclosed in, for example, Japanese Patent Laid-Open Publication No. 35882/1988.

Any of the image forming processes described above is practicable with a single toner of particular color or a plurality of toners of different colors. When use is made of toners of different colors, a multicolor or a full-color image is achievable. Hence, by combining the toners of different colors and the different transfer processes, it is possible to implement:

(1) a monocolor or superposed-color one-sided front record mode;

(2) monocolor or superposed-color one-sided rear record mode; and (3) monocolor or superposed-color two-sided record mode.

It is to be noted that the term "record mode" is equivalent to "copy mode", and that the term "superposed color" refers to both of multicolor and full-color.

The transfer means for executing the above-stated record modes may be implemented by roller transfer in addition to corona transfer and belt transfer. The roller transfer uses a bias roller made of conductive rubber or a dielectric roller produced by covering the surface of the bias roller with a dielectric film. Such a roller is pressed against the rear surface of a recording medium to form an electric field. The roller transfer causes a smaller amount of discharge to occur in an air gap than corona transfer or similar transfer, thereby suppressing the fall of the field effect and, therefore, enhancing transfer efficiency.

However, to execute any of the above-stated record modes, it is necessary to select a particular voltage application state for each of the transferring medium and secondary toner image transferring medium, so that images may be effectively transferred. Regarding the secondary toner image transfer means, among others, it is desirable to enhance the transfer quality by improving the transfer efficiency and eliminating defective images at the time of transfer, since the image on the transfer means of interest has been transferred from the photoconductive element. At the present stage of technologies, however, practical implementions or means capable of meeting the above requirement have not been reported.

After the image transfer, the paper sheet or similar recording medium is separated from the photoconductive element and then transported to a fixing device. At this instant, if the transfer characteristic does not have a sufficient margin, discharge is apt to occur at the time of separation to produce a defective toner image such as a locally omitted toner image or a blurred or dislocated toner image.

Further, the paper sheet is transported by the transport belt simply relying on the nip pressure acting between the photoconductive element and the transfer belt. In this condition, the leading edge of the paper sheet moved away from the transfer position is apt to lift away from the transfer belt or otherwise behave unstably, obstructing the stable entry of the paper sheet in the fixing device.

SUMMARY OF THE INVENTION

It is therefore an object of the present invention to provide an image forming apparatus which eliminates the drawbacks particular to the conventional apparatus as discussed above.

It is another object of the present invention to provide an image forming apparatus which increases transfer efficiency, eliminates defective images, and insures stable transport of a recording medium to a fixing device.

It is another object of the present invention to provide a generally improved image forming apparatus.

An image forming apparatus for forming an image on one or both sides of a recording medium of the present invention comprises a rotatable photoconductive element, an optical writing device for electrostatically writing a latent image on the photoconductive element as a mirror image or a non-mirror image, a developing device for developing the latent image to produce a primary toner image, an intermediate transfer body in the form of a belt located to face the photoconductive element, an intermediate transfer device for selectively transferring the primary toner image to the recording medium or transferring the primary toner image to the belt as a secondary toner image, and a secondary toner image transfer device for transferring the secondary toner image to the recording medium. The secondary toner image transfer device comprises a bias roller which is located in close proximity to the upper surface of the belt and downstream of a position where the belt directly faces the photoconductive element with respect to an intended direction of movement of the belt.

Also, an image forming apparatus of the present invention comprises a rotatable photoconductive element, an optical writing device for electrostatically writing a latent image on the photoconductive element as a mirror image or a non-mirror image, a developing device for developing the latent image to produce a primary toner image, an intermediate transfer body in the form of a belt located to face the photoconductive element, a primary toner image transfer device for transferring the primary toner image to the belt or to a recording medium as a secondary toner image, and a secondary toner image transfer device for transferring the secondary toner image from the belt to the recording medium. The secondary toner image transfer device comprises bias rollers located, respectively, upstream and downstream of the primary toner image transfer device with respect to an intended direction of movement of the recording medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a brief reference will be made to a prior art image forming apparatus implemented as a copier which is selectively operative in a one-sided rear copy mode or a two-sided copy mode, shown in FIG. 17. As shown, the copier has a photoconductive element in the form of a drum A. A toner image is formed on the drum A by a conventional arrangement for forming a latent image and a conventional structure for forming a toner image. A transfer belt B serves as an intermediate transfer body and is located to face the drum A at a predetermined transfer position. A primary toner image transfer unit C faces the drum A with the intermediary of the transfer belt B in such a manner as to electrostatically transfer the toner image from the drum A to the belt B. The primary toner image transfer unit C operates when a toner image is to be directly transferred to one side of a paper sheet fed to the transfer position at a predetermined timing by a register roller, not shown, and when toner images are to be transferred to both sides of the paper sheet.

A secondary toner image transfer unit D is located above the transport surface of the transfer belt B. The secondary toner image transfer unit D has a charging characteristic opposite in polarity to a toner image carried on the transfer belt B, while the primary toner image transfer unit C has a charging characteristic opposite in polarity to a toner image carried on the drum A. Hence, when a toner image is to be directly transferred to one side of a paper sheet or when toner images are to be transferred to both sides of a paper sheet, a toner image is directly transferred from the drum A to one side of the paper sheet or to the transfer belt B by the primary toner image transfer unit C. In the case of a two-sided copy mode, after another toner image has been formed on the drum A, the toner image on the belt B and the toner image on the belt A are respectively transferred to one side and the other side of a paper sheet by the primary image transfer unit C. Further, the toner image transferred to the other side of the paper sheet is urged against the paper sheet by the secondary toner image transfer unit D. By the above procedure, toner images can be transferred to either side of a paper sheet without the paper sheet being turned over.

Figure 17:
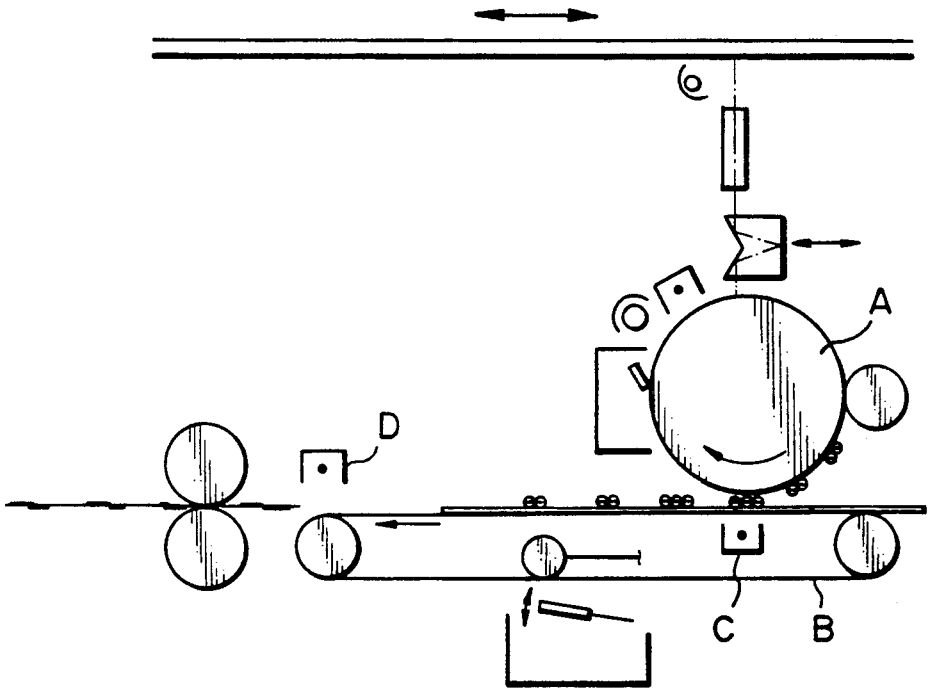
FIG. 17 PRIOR ART
FIG. 17 shows a conventional transfer means.

As shown in FIG. 17, the conventional apparatus transfers a toner image at a position where the drum A and the primary toner image transfer unit C face each other with the intermediary of the transfer belt B. In such a configuration, the time available for the application of a bias potential which is necessary for image transfer is short, so that the transfer efficiency is apt to fall. Should the bias potential be increased to eliminate the above problem, electric noise and electromagnetic interference would be brought about to effect electric circuitry. Moreover, higher bias potentials are undesirable from the safety operation standpoint. After the image transfer, the paper sheet is separated from the drum A and then transferred to a fixing unit. When the transfer characteristic or the margin thereof is limited as stated above, it is likely that a discharge occurs at the time of separation to produce a defective image such as a locally omitted image or a blurred image. Further, the paper sheet is transported by the belt B simply on the basis of the nipping pressure acting between the drum A and the belt B. Hence, the leading edge of the paper sheet moved away from the transfer position is apt to rise away from the belt B or otherwise behave unstably, preventing the paper sheet from being introduced in the fixing unit stably.

Figure 1:
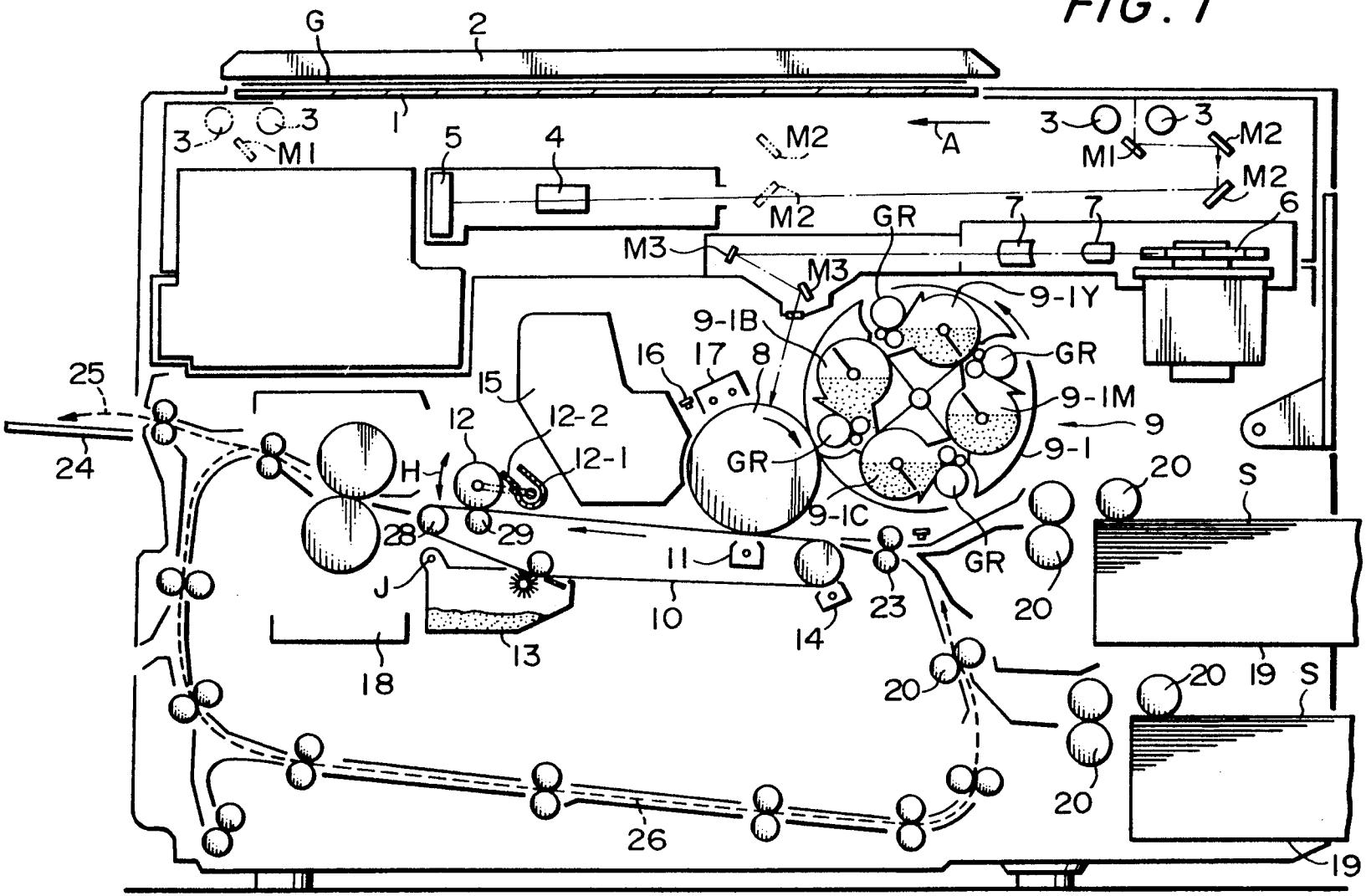
FIG. 1 is a view showing the general construction of an image forming apparatus embodying the present invention.

Referring to FIG. 1, an image forming apparatus embodying the present invention is shown which is implemented as a color copier by way of example. The color copier is generally made up of document reading means, optical writing means, image forming means and fixing means, paper feeding means, and paper transporting means.

As shown in FIG. 1, the document reading means has a glass platen 1 for laying document G thereon, a cover plate 2 for covering the glass platen 1 and document G, a lamp 3 for illuminating the document G, a first group of mirrors M1 movable in a scanning direction A integrally with the lamp 3, a second group of mirrors M2 movable in the direction A in interlocked relation to the first mirrors M1, a reduction lens 4, a color CCD (Charge Coupled Device) image sensor 5, and a scanner controller, not shown. As the document G is scanned by illumination, image data representative of the document G is converted into electric blue, green, red and black signals by the color CCD image sensor and then written to store means. Further, the electric signals are processed by an image processing section, not shown, and then transferred to the optical writing means.

The optical writing means has a semiconductor laser, means for superposing the above-mentioned electric signals on a current for driving the laser, a rotary polygonal mirror 6 for steering a beam issuing from the laser, optics 7 including an f-theta lens, and a mirror M3 for reflecting the beam toward a photoconductive element in the form of a drum 8. Since the optical writing means stores the image data as digital signals, the writing order of the image data on the drum 8, for example, may be changed to produce a mirror image on the drum 8, if desired.

The image forming means has the drum 8 rotatable in a direction indicated by an arrow, developing means 9 for developing a latent image electrostatically formed on the drum 8 by the writing means to produce a primary toner image, an intermediate transfer body in the form of a belt 10 located to face the drum 8, intermediate transfer means implemented as a charger 11 which faces the drum 8 and oriented toward the inner periphery of the belt 10, a bias roller 12 disposed above the belt 10 and downstream of the position where the belt 10 faces the drum 8, i.e., downstream of the charger 11 with respect to the moving direction of the belt 10, belt cleaning means 13 located downstream of the bias roller 12, and a charger 14 facing the belt 10 at a position downstream of the belt cleaning means 13 and playing the role of polarity reversing means for two-sided copying. A cleaner 15, a discharge lamp 16 and a main charger 17 are arranged around the drum 8. The belt 10 is implemented by a dielectric sheet such as a polyester film or 4-vinylidene fluoride or a belt having medium resistance such as a rubber belt or a carbon-containing polycarbo sheet whose surface resistance is $10^8$ Ω.cm to $10^{13}$ Ω.cm. The developing means 9 has four developing units each being accommodated in respective one of four compartments defined in a rotatable cylinder 9-1. Specifically, developing units 9-1Y, 9-1M, 9-1C and 9-1B accommodating a yellow toner, a magenta toner, a cyan toner and a black toner, respectively, are accommodated in the cylinder 9-1. The cylinder 9-1 is rotated until one of the developing units 9-1Y through 9-1B that matches in color a latent image which should be developed faces the drum 8. The belt cleaning means 13 is rotatable about a pivot J, i.e., movable toward and away from the belt 10, as needed.

The fixing means which is designated by the reference numeral 18 is located downstream of the belt 10 and fixes a toner image carried on a paper sheet by heat. The paper feeding means has paper feeding sections 19 each being loaded with paper sheets S, paper separating and feeding rollers 20, and a register roller 23. The paper transporting means has rollers and guides arranged along a path 25 extending from the fixing means 18 to a stack section 24, rollers and guides arranged along a path 26 extending from the fixing means 18 to the register roller 23, and pawls or selectos for selecting any of such paths. In the illustrative embodiments, two different paper transport modes are available, i.e., a one-path mode and a recycle mode. In the one-path mode, a paper sheet from any of the paper feeding section 19 is transported to the fixing means 18 via the drum 8 and then to the path 25. In the recycle mode, the paper sheet reached the fixing means 18 is routed through the path 26, register roller 23, drum 8, fixing means 18, and path 25 in this sequence to reach the stack section 24.

The bias roller 12 is made of dielectric rubber. The bias voltage to be applied to the bias roller 12 is switched over by bias applying means. A cleaner 12-1 has a blade 12-2 which is held in contact with the bias roller 12. The bias roller 12 is movable into and out of contact with the belt 10 in a direction indicated by an arrow H. The bias roller 12 and cleaner 12-1 are connected to each other by an arm, not shown, at shaft portions thereof. This arm is rotated to move the bias roller 12 toward and away from the belt 10, as stated above. To rotate the arm, use may be made of a spring and solenoid device, for example.

In FIG. 1, the intermediate transfer means is implemented as the charger 11 which is corona transfer means, while the secondary toner image transfer means is implemented as the bias roller 12. Such transfer means may be modified in various manners, as follows.

Figure 2:
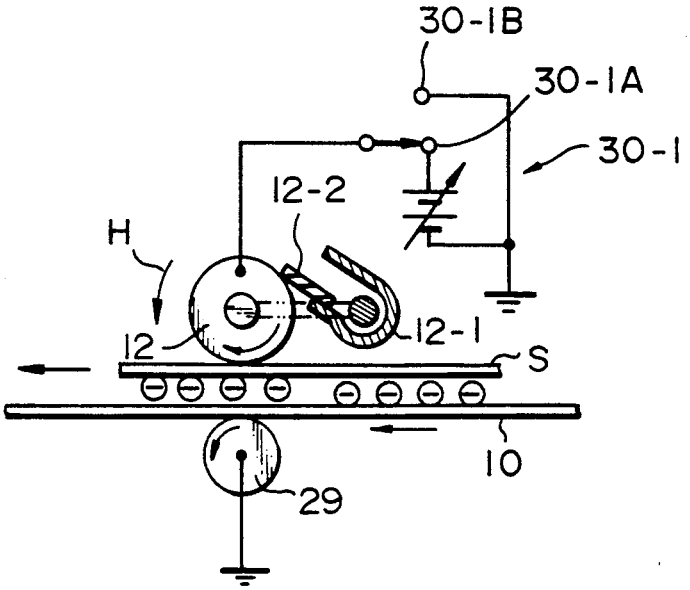
FIG. 2 shows a specific construction of transfer means included in the embodiment.
Figure 3:
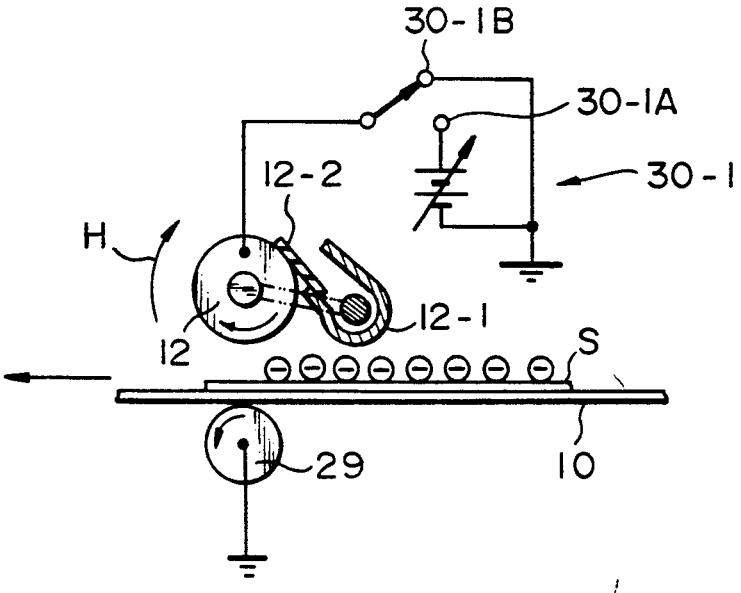
FIG. 3 is indicative of the operation of the transfer means shown in FIG. 2.

Example 1: The secondary toner image transfer means is implemented by the bias roller 12 and a single counter electrode roller 29, as shown in FIGS. 1 through 3. The bias roller 12 is movable into and out of contact with the belt 10 at a position just before, among the rollers that support the belt 10, a roller 28 located at the downstream side with respect to the direction of paper transport and serving to separate a paper sheet from the belt 10. Bias applying means 30-1 is associated with the bias roller 12. The bias applying means 12 has a terminal 30-1A connected to a positive variable power source, a terminal 30-1B connected to ground, and a switch selectively connecting to either one of the terminals 30-1A and 30-1B depending on the record mode selected. The counter electrode roller 29 is held in contact with the inner periphery of the belt 10 and faces the bias roller 12.

As shown in FIG. 2, in a rear record mode, a negatively charged, monochromatic primary toner image is transferred from the drum 8 to the belt 10 by the charger 11. A paper sheet S is fed onto the toner image carried on the belt 10, i.e., a secondary toner image and then transported toward the bias roller 12 together with the toner image. At this instant, the bias roller 12 has been switched into connection with the terminal 30-1A and pressed against the belt 10. As a result, while the paper sheet S passes the bias roller 12 and counter electrode roller 29, the secondary toner image is transferred from the belt 10 to the paper sheet S. This is also true with the transfer of a superposed-color toner image.

Since this example uses the charger 11 which effects corona transfer as the intermediate transfer means, a minimum of pressure acts on the drum 8. Hence, although carrier particles and impurities such as paper dust may enter the transfer station, the drum 8 is free from damage and, therefore, durable and reliable enough to insure high quality images. The bias roller 12 playing the role of the secondary toner image transfer means enhances efficient operations. This is especially true with a laminate color image constituted by yellow, magenta, cyan and black toners because of the decrease in void discharge and the effective use of transfer pressure and electric field. The counter electrode roller 29 allows the field intensity in the transfer region to be set up efficiently. In this example, the voltage applied to the bias roller 12 has positive polarity because the secondary toner image has negative polarity. The gist is that the polarity of the voltage of interest be opposite to the polarity of the secondary toner image, In this manner, this example makes most of the advantages particular to corona transfer and bias roller transfer.

As shown in FIG. 3, in a front record mode, the negatively charged primary toner image is transferred from the drum 8 to the paper sheets S carried on the belt 10 by the corona transfer effected by the charger 11. In this mode operation, the bias applying means 30-1 is connected to the terminal 30-1B and retracted to a position where it does not contact the paper sheet S. This is partly because the bias roller 12 does not have to function and partly because the image should be prevented from being disturbed.

Figure 4:
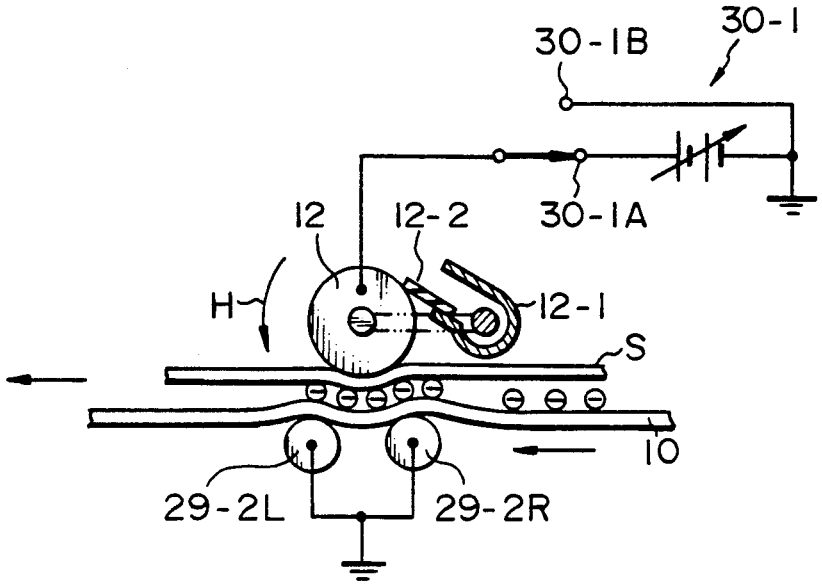
FIG. 4 shows another specific construction of the transfer means.
Figure 5:
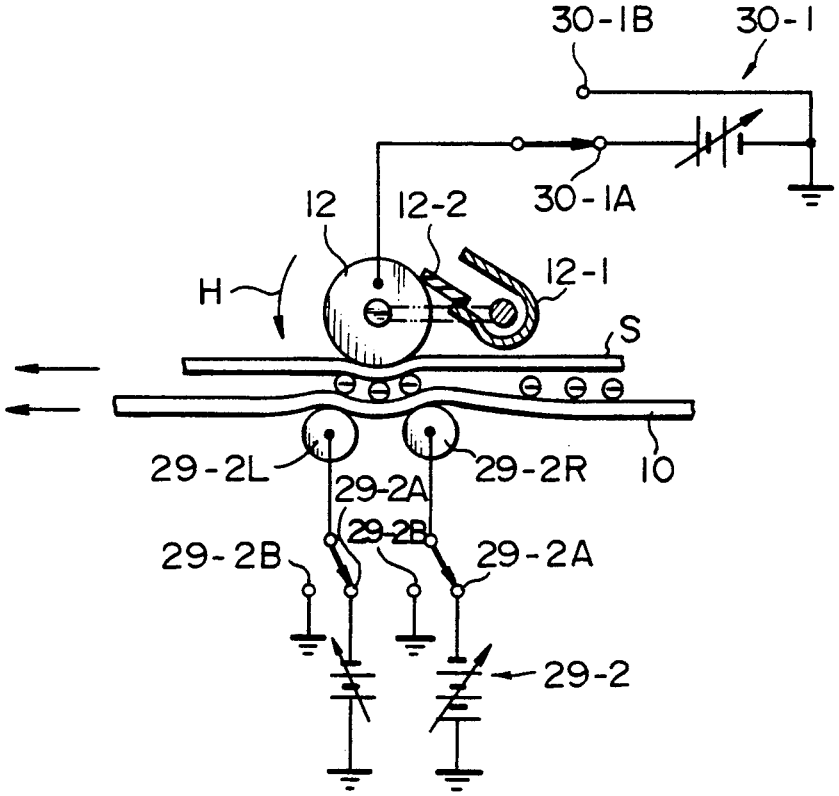
FIG. 5 is indicative of the operation of the transfer means shown in FIG. 4.
Figure 6:
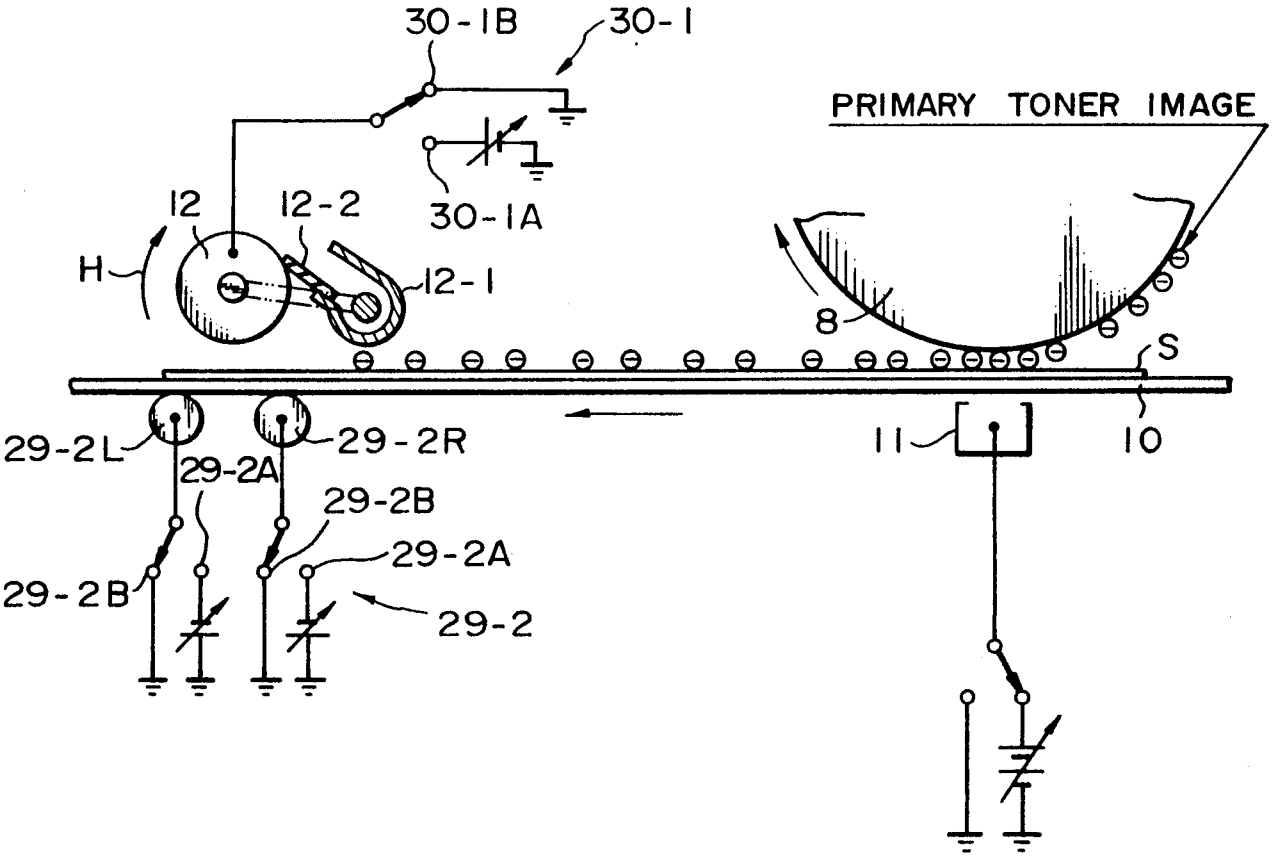
FIG. 6 shows another specific construction of the transfer means.

Example 2: As shown in FIGS. 4–6, Example 2 is different from Example 1 in that the single counter electrode roller 29 of FIGS. 1–3 is replaced with a plurality of counter electrode rollers, i.e., counter electrode rollers 29-2R and 29-2L in this example.

Example 2-1: As shown in FIG. 4, the counter electrode rollers 29-2R and 29-2L are held in contact with the inner periphery of the belt 10 and so located as to face the bias roller 12 at positions other than the position just below the roller 12. Both of the rollers 29-R and 29-L are connected to ground. While FIG. 4 shows the transfer of a monochromatic toner image to the rear surface of a paper sheet S, this arrangement is similarly applicable to a superposed-color image. In this configuration, the bias roller 12 urges the portion of the belt 10 which intervenes between the counter electrode rollers 29-R and 29-L. Hence, the belt 10 and paper sheet S deform along the periphery of the bias roller 12, i.e., the transfer region is extended due to surface-to-surface contact. This is successful in further increasing the transfer efficiency and insuring uniform transfer. With the extended contact surface, it is possible to implement each of the bias roller 12 and counter electrode rollers 29-2R and 29-2L as an almost nearly rigid metallic roller. In such a case, conductive rubber is not necessary and, therefore, the mechanical accuracy and durability of such rollers will be enhanced. The bias applying means 30-1 is switched over depending on the record mode, as in Example 1. Further, since a high pressure is not needed in the transfer region, stresses due to the rolling, for example, of the intermediate transfer belt, bias roller and counter electrodes which are necessary in effecting uniform transfer on a line-to-line contact basis are reduced, whereby durability is enhanced. In this connection, since the belt is free from high pressure, it does not meander or otherwise behave irregularly and, therefore, promotes accurate register of images. In addition, a simple belt drive mechanism suffices. Example 2-2: As shown in FIGS. 5 and 6, bias applying means 29-2 is associated with the counter electrode rollers 29-2R and 29-2L. The bias applying means 29-2 has terminals 29-2A connected to a negative variable power source, terminals 29–2B connected to ground, and switches each being selectively connectable to either one of the associated terminals 29-2A and 29-2B depending on the record mode. As shown in FIG. 5, in a rear record mode, the bias roller 12 is connected to the terminal 30-1A to be applied with a positive bias voltage, while the counter electrode rollers 29-2R and 29-2L are connected to the associated terminals 29-2A to be applied with a negative bias voltage. The charger 11 to which a positive bias is applied produces a negatively charged secondary image on the belt 10, and then the bias roller 12 and counter electrode rollers 29-2R and 29-2L transfer the toner image to the rear surface of a paper sheet S. As shown in FIG. 6, in a front record mode, the bias power source associated with the charger 11 is switched to the positive polarity so as to transfer a negatively charged primary toner image from the drum 8 to a paper sheet S carried on the belt 10. At this instant, the bias roller 12 is moved away from the belt 10, and both the bias roller 12 and the counter electrode rollers 29-2R and 29-2L are connected to ground, as in Example 1.

As stated above, this example applies a bias voltage to the counter electrode rollers 29-2R and 29-2L also, further promoting efficient transfer. Since the bias applying means each is connected to a variable voltage source, the bias voltage can be changed to eliminate the contact in the event of transfer and the unusual discharge in the event of paper separation, thereby insuring uniform transfer. Changing the bias voltage is also successful in coping with fully-color copy, bicolor copy and monochromatic copy each having particular transfer conditions. Moreover, since a paper sheet S is held between the belt 10 and the bias roller 12 during image transfer, it is prevented from being dislocated even when subjected to some externally derived force. This eliminates defective images such as a dislocated image, a blurred image and a locally omitted image. For the same reason, even a limp, thin or waved paper sheet can be surely transported to the fixing station without jamming the path. Even in a full-color mode or a multicolor mode, images can be transferred efficiently despite that the resultant toner image has multiple layers and a great amount of toner.

Figure 7:
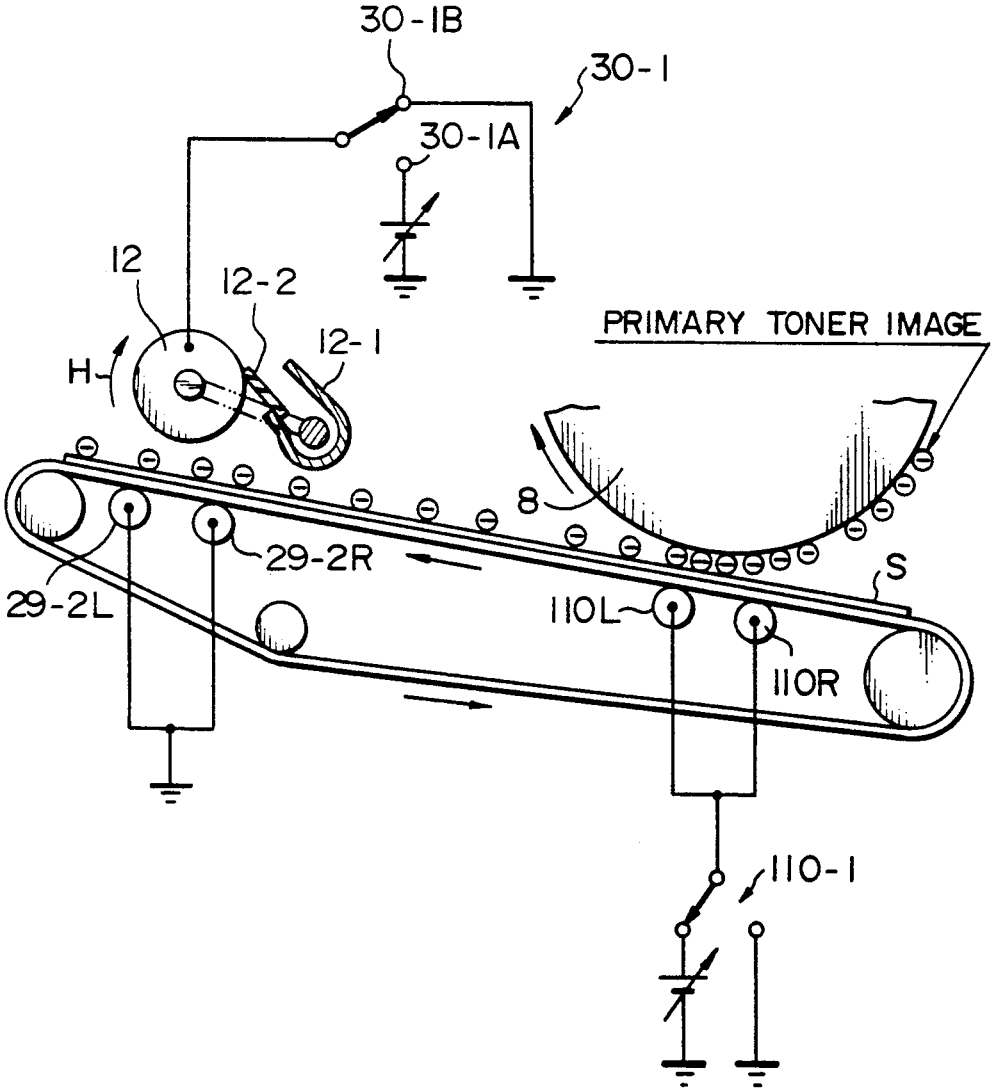
FIG. 7 shows still another specific construction of the transfer means.

Example 3: As shown in FIGS. 4 and 7, this example implements the intermediate transfer means by a plurality of bias rollers. Specifically, as shown in FIG. 7, bias rollers 110R and 110L are located to face the drum 8, and bias applying means 110-1 is associated with the rollers 110R and 110L. This example executes a rear record mode operation in the same manner as Example 2-1 (FIG. 4). As shown in FIG. 7, in a front record mode, the bias rollers 110R and 110L to which a positive bias voltage is applied transfer a negatively charged primary toner image from the drum 8 to a paper sheet S. In the meantime, the bias roller 12 is retracted from the belt 10, and the bias applying means 30-1 is connected to ground.

Figure 8:
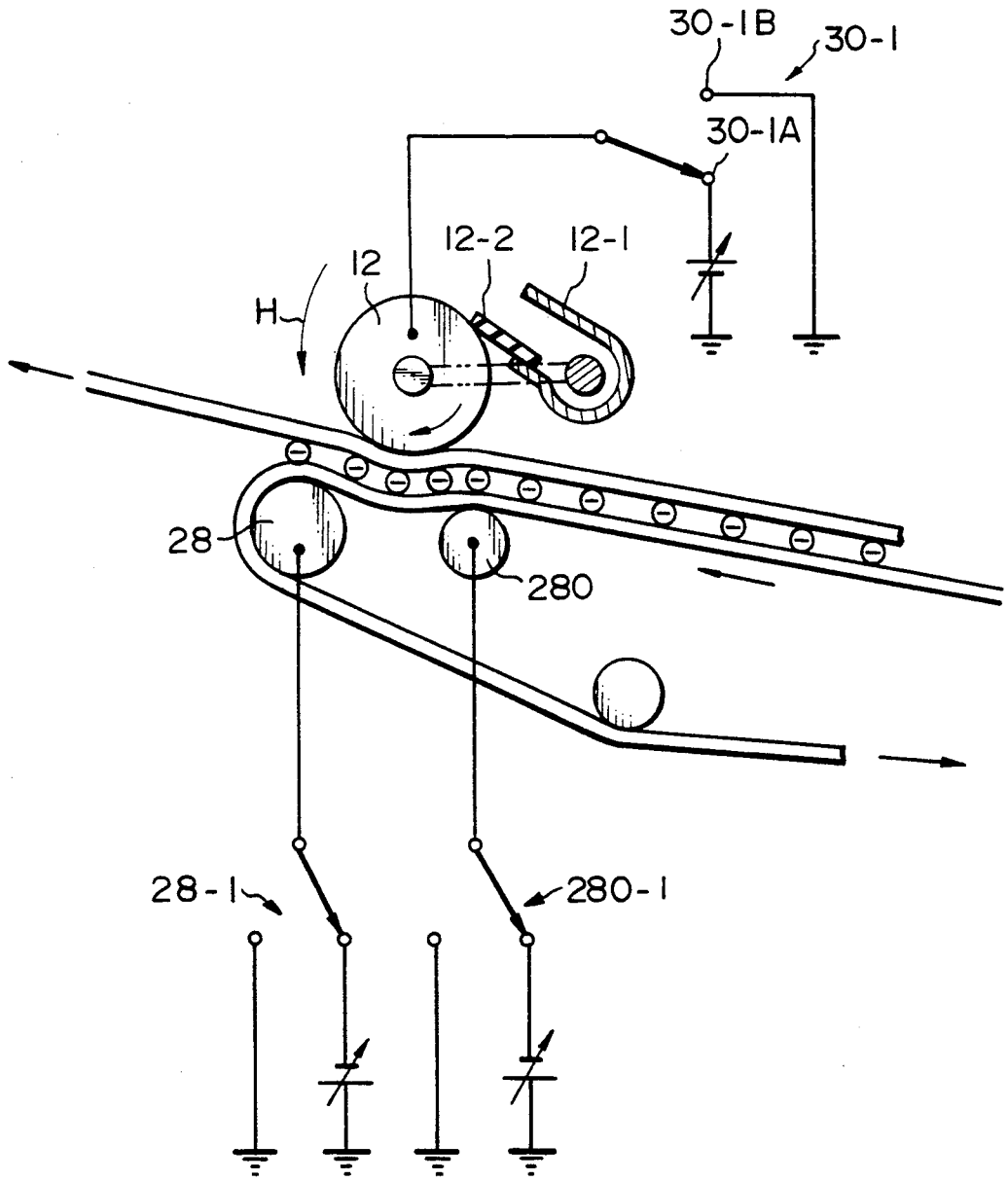
FIG. 8 shows yet another specific constriction of the transfer means.
Figure 9:
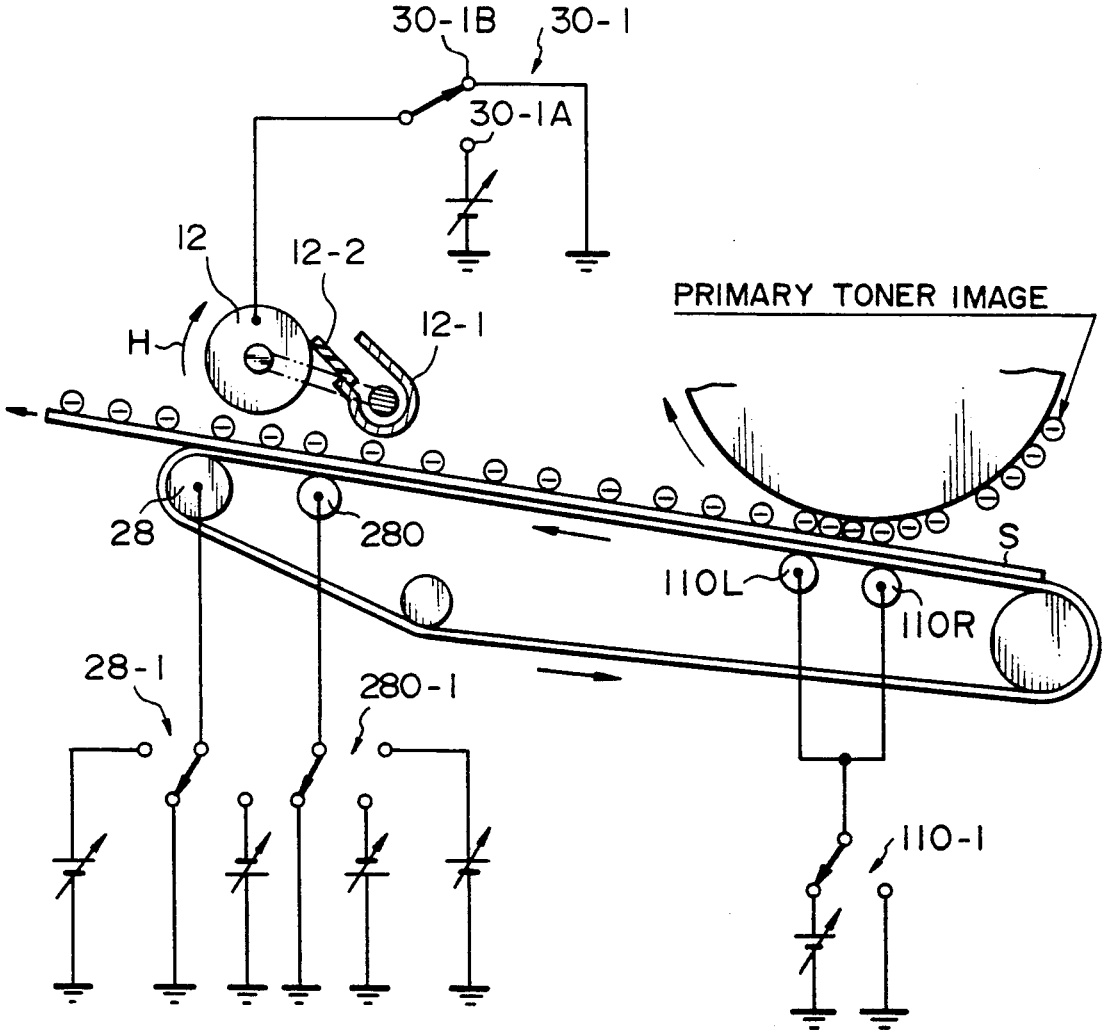
FIG. 9 shows a further specific construction of the transfer means.

Example 4: As shown in FIGS. 8 and 9, a counter electrode roller 280 is located in the vicinity of and upstream of, among the rollers which support the belt 10, the roller 28 located on the downstream side and serving to separate a paper sheet S from the belt 10. Bias applying means 28-1 and 280-1 are associated with the support roller 28 and the counter electrode roller 280, respectively. These rollers 28 and 280 play the role of counter electrodes coactive with the bias roller 12. The bias roller 12 intervenes between the rollers 28 and 280 and moves into and out of contact with the belt 10. The intermediate transfer means is implemented by the bias rollers 110R and 110L and bias applying means 110-1, as in Example 3 (FIG. 7). As shown in FIG. 8, in a rear record mode, the bias roller 12 is held in contact with the belt 10 and applied with a positive bias voltage, while the support roller 28 and counter electrode rollers 280 each is applied with a negative voltage. In this condition, a negatively charged secondary toner image is transferred to a paper sheet S. A front record mode operation is effected in the manner shown in FIG. 9, i.e., in the same manner as in Example 3 (FIG. 7). The polarity and value of the voltage to be applied to the bias applying means 28-1 and 280-1 is suitably selected in matching relation to the kind of paper sheets S.

In this example, the support roller 28 has an outside diameter of 25 mm to 10 mm, and the separation of a paper sheet is stabilized by a curvature separation system. Especially, in a rear record mode, the bias roller 12 insures accurate transfer of a paper sheet by eliminating jams. The transfer of a toner image to a paper sheet and the separation of the paper sheet are effected at a position close to the support roller 28, causing a minimum of unusual discharge to occur when the paper sheet is separated. The unusual discharge would disturb the toner image transferred to the paper sheet. In this connection, should the belt 10 and the paper sheet S be held in contact over a long period of time after the transfer of a toner image, the charges deposited on the toner and belt would undergo gaseous discharge at the time of separation of the paper sheet to lower the transfer efficiency and disturb the image. The transfer efficiency is further enhanced by the bias applying means associated with each of the support roller 28 and counter electrode roller 280 and by the transfer nip guaranteed by the bias roller 12 and roller 28. This is also true with a full-color copy and a multicolor copy mode. Even in a front record mode, the bias is controlled in the event of separation of the paper sheet from the belt 10 to thereby eliminate unusual discharge which would disturb the image.

Figure 10:
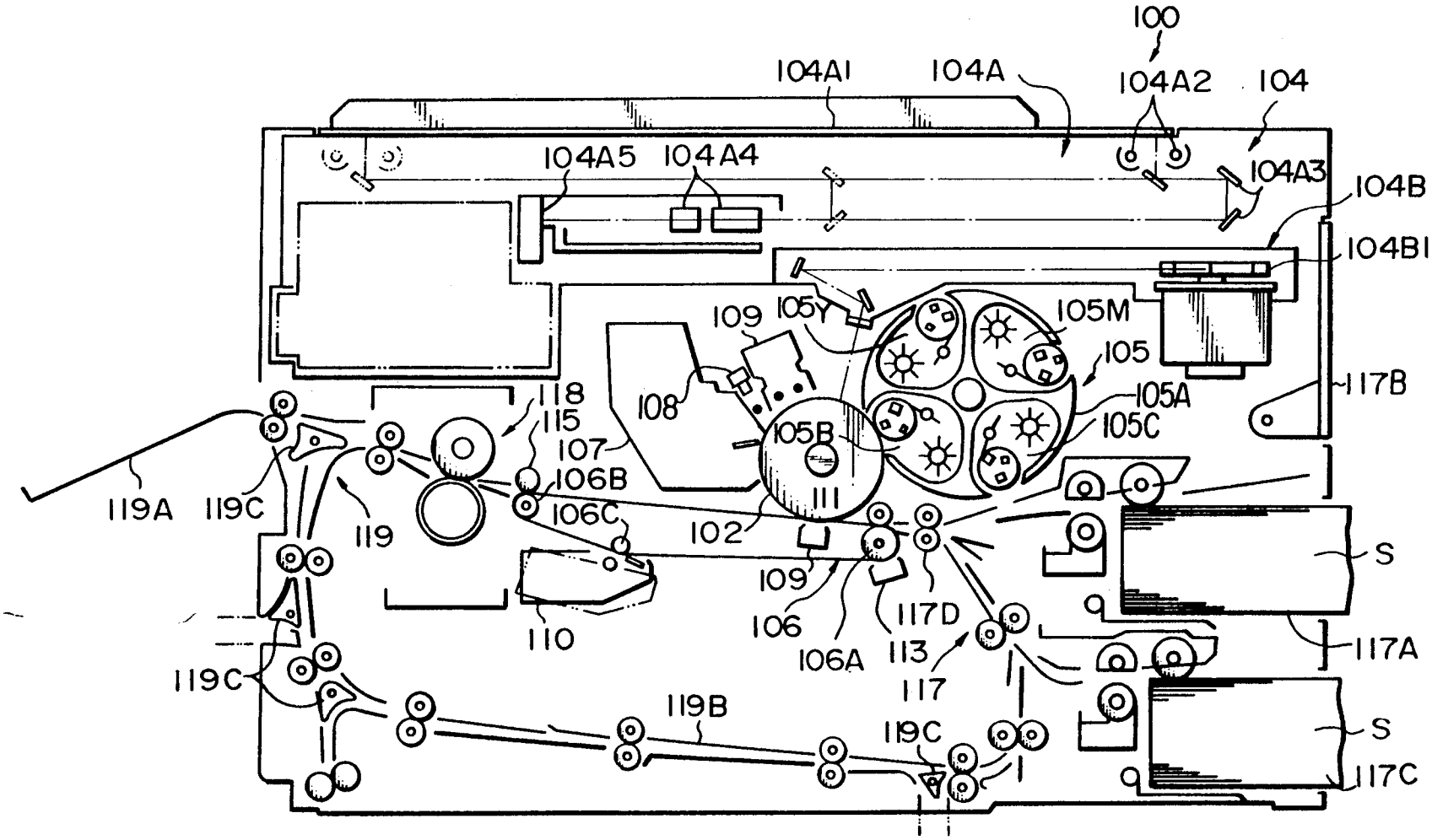
FIG. 10 is a view showing the general construction of an alternative embodiment of the present invention.

Referring to FIGS. 10 through 16, an alternative embodiment of the present invention will be described. This embodiment is characterized in that a bias roller is located at each of the upstream side and the downstream side of the intermediate transfer body, or belt, with respect to the paper transport direction. Specifically, as shown in FIG. 10, an image forming apparatus has a photoconductive element implemented as a drum 102 which is rotatable in a direction indicated by an arrow. A charger 109, an optical writing device 104, a developing device 105, an intermediate transfer body 106, and a cleaning device 107 are sequentially arranged around the drum 102 in this order to execute an image forming procedure.

The optical writing device 104 has a document reading section 104A and a writing section 104B and, as in the previous embodiment, electrostatically forms a latent image on the drum 102 by a laser beam. The document reading device 104A has a light source 104A2, a mirror 104A3 and a lens 104A4 which are movable in a reciprocating motion for scanning a document laid on a glass platen 104A1, and a color CCD image sensor 104A5 to which a reflection from the document is focused via the above-mentioned optical members. The color CCD image sensor 104A5 separates the reflection incident thereto into color components. The color components are written to a store, not shown, as digital signals and used to control the output of a laser included in the writing device 4B.

The writing section 104B1 has a rotary polygonal mirror 104B1 for deflecting a laser beam issuing from the laser, and various focusing optical members including an f-theta lens and mirrors. A laser beam issuing from the laser is steered in the axial direction of the drum 102 to write a document image on the drum 102. The order of writing the digital signals on the drum 102 may be changed to form a mirror image on the drum 102, if desired.

The developing device 105 develops the latent image formed on the drum 102 and is constructed and arranged as to implement color copying, as in the previous embodiment. The device 105 has a rotatable holder 105A accommodating magnet brush type developing units 105B, 105C, 105M and 105Y. The developing units 105B, 105C, 105M and 105Y store respectively black, cyan, magenta and yellow developers therein. The cyan, magenta and yellow developers are complementary to three primary colors, i.e., red, green and blue, while the black developer is used to render tones and to implement black-and-white copying. The developing device 105 brings one of the developing units 105B through 105Y matching a desired copy mode to a position where a developing sleeve thereof faces the drum 102.

Figure 11:
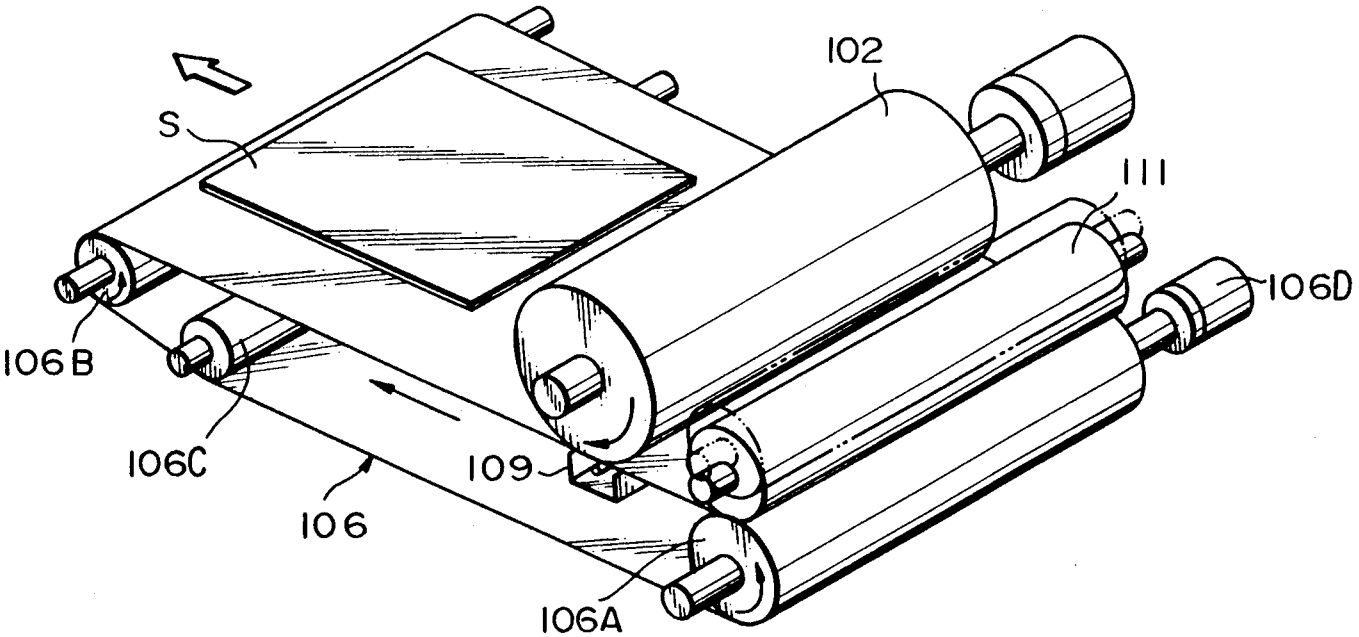
FIG. 11 is a perspective view showing a specific construction of transfer means included in the embodiment of FIG. 10.

The intermediate transfer body 106 is implemented as a belt located in the vicinity of the drum 102 and made of resin or rubber having medium resistance, e.g. $10^{-8}\Omega$.cm to $10^{-11}\Omega$.cm. As shown in FIG. 11, the belt 106 is passed over a pair of rollers 106A and 106B which are spaced apart in the direction of paper transport (indicated by an arrow in the figure). One of the rollers 106A and 106B which tends to slacken the surface of the belt 106, i.e., the roller 106A in the embodiment is connected to a drive motor 106C. The roller, or drive roller, 106A drives the belt 106 such that the belt 106 moves in the same direction as the drum 102 at the position where the former faces the latter.

Figure 12:
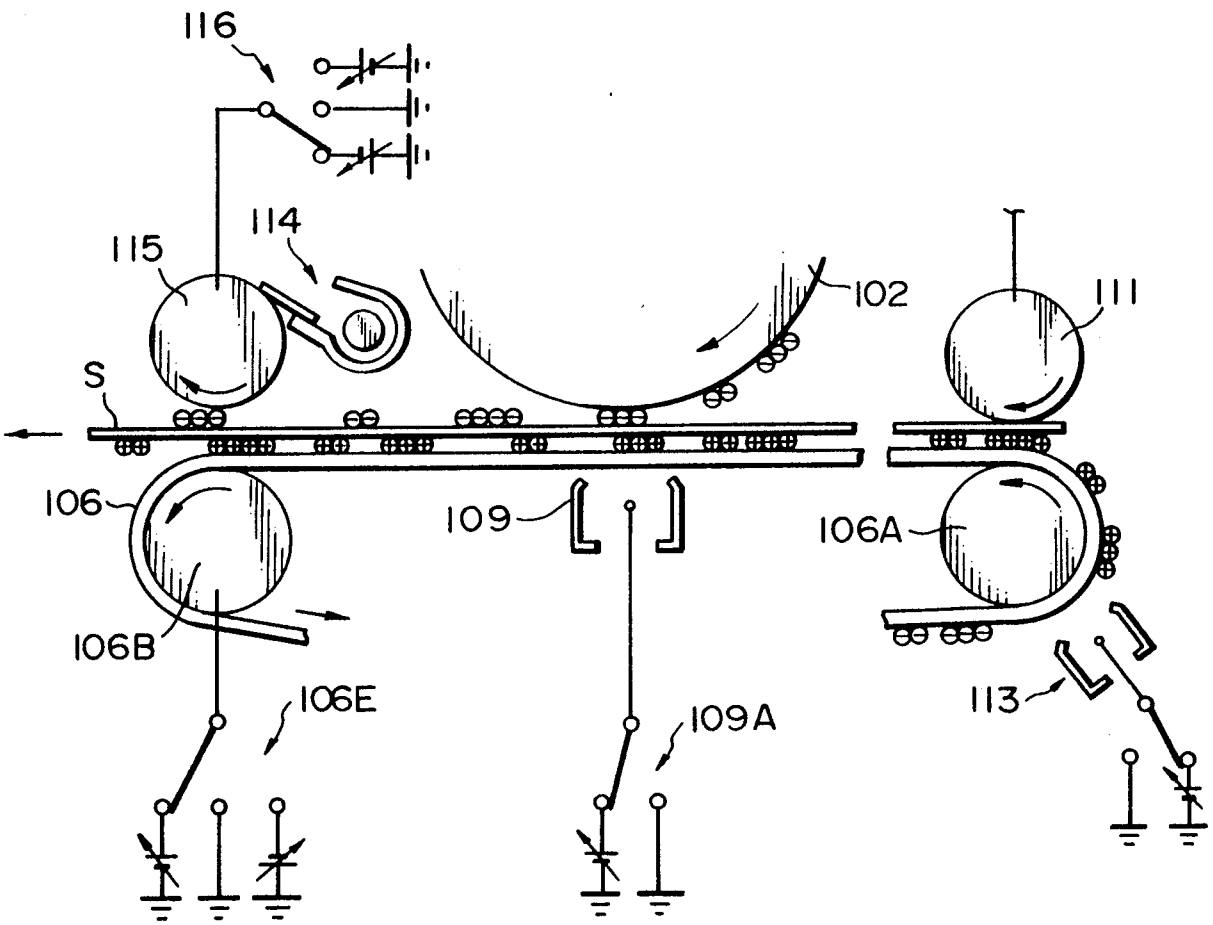
FIG. 12 is a view indicative of the operation of the transfer means shown in FIG. 11.

The cleaning device 107 has a blade, as in the previous embodiment. The blade scrapes off a developer remaining on the drum 102 after image transfer. A discharge lamp 108 removes the charge remaining on the drum 102 having been cleaned by the cleaning device 107. As shown in FIG. 12, a primary image transfer device 109 is located to face the drum 102 with the intermediary of the belt 106 and has a bias circuit 109A whose polarity is changeable. The primary image transfer device 109 transfers the toner image or primary toner image from the drum 102 to a paper sheet S or the belt 106. A tension roller 106C, FIG. 10, is positioned in close proximity to the roller 106B. A cleaning device 110, FIG. 10, has a blade similar to the blade associated with the drum 102 and faces the tension roller 106C with the intermediary of the belt 106. The blade of the cleaning device 110 is movable into and out of contact with the belt 106, i.e., it is moved away from the belt 106 when a secondary toner image is carried on the belt 106.

Figure 13:
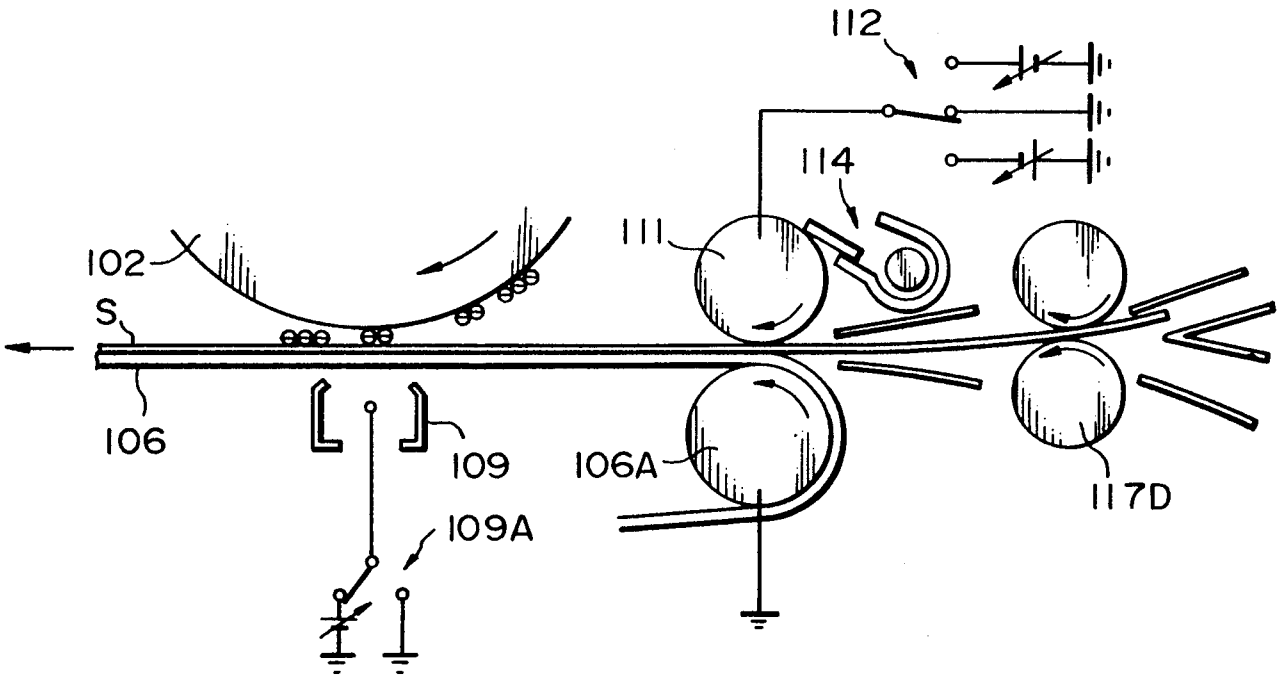
FIG. 13 shows another specific construction of the transfer means shown in FIG. 11.

As shown in FIG. 11, a bias roller 111 is located to face the drive roller 106A with the intermediary of the belt 106. As shown in FIG. 13, the bias roller 111 is connected to a bias circuit 112 whose polarity is changeable. The bias roller 111 is movable into and out of contact with the paper sheet S laid on the belt 106, i.e., it is brought into contact with the paper sheet S when the toner image or secondary toner image carried on the belt 106 is to be transferred to one side of the paper sheet S. As shown in FIG. 12, a charger 113 faces the drive roller 106A with the intermediary of the belt 106 and changes the polarity of the secondary toner image carried on the belt 106. A cleaner 114 for cleaning the bias roller 111 has a blade remaining in contact with the bias roller 111 and thereby removes the toner particles from the bias roller 111.

A bias roller 115 for transfer and paper separation is located at the opposite side to the bias roller 111, i.e., downstream side with respect to the drum 102 and is movable into and out of contact with the paper sheet S laid on the belt 106. Specifically, the bias roller 115 faces the roller, or driven roller, 106B and is connected to a bias circuit 116 whose polarity is changeable. The bias roller 115 is brought into and out of contact with the paper sheet S at the same time as the bias roller 111, i.e., it contacts the paper sheet S when the secondary image is to be transferred from the belt 106 to the paper sheet S. A cleaner 114 is associated with the bias roller 115.

The driven roller 106B is connected to a bias circuit 106E which contributes to the transfer and paper separation. The polarity of the bias circuit 106E is changeable to set the behavior of the secondary toner image carried on the belt 106. When the primary toner image is to be transferred from the drum 102 to the belt 106 or when the secondary toner image is to be transferred from the belt 106 to one side of the paper sheet S in a two-sided copy mode, the bias circuit 106E switches the polarity thereof to the opposite polarity to the primary toner image formed on the drum 102 or to the same polarity as the secondary toner image. When the secondary toner image is to be transferred to from the belt 106 to only one side of the paper sheet S, the bias circuit 106E is connected to ground. Further, to remove toner particles remaining on the belt 106, the bias circuit 106E changes the polarity thereof to the opposite polarity to the secondary toner image. Regarding such a charging characteristic, the bias circuit 112 associated with the bias roller 111 is identical with the bias circuit 106E.

In FIG. 10, a paper feed mechanism 117 is located upstream of the belt 106 with respect to the paper transport direction, while a fixing device 118 and a paper discharge mechanism 119 are located downstream of the belt 106. The paper feed mechanism 117 has a paper cassettes 117A and 117B each being loaded with a stack of paper sheets S of particular size, and a tray 117C for the manual insertion of paper sheets. A paper sheet fed from any one of the cassettes 117A and 117B and tray 117C is driven toward the drum 102 at a predetermined timing by a register roller 117D such that it meets an image formed on the drum 102 accurately. In the illustrative embodiment, the paper discharge mechanism 119 steers the paper sheet S coming out of the fixing device 118 toward a discharge tray 119A, a sorter, not shown, or a recycle path 119B, as needed. A selector in the form of a pawl 119C is located at the position where the path branches so as to select a particular paper discharge direction.

The operation of the illustrative embodiment will be described with reference to FIGS. 12 through 16. It is to be noted that the copy modes shown in FIGS. 12 to 16 is each based on the transfer of a toner image formed by a single toner of particular color by way of example.

Figure 14:
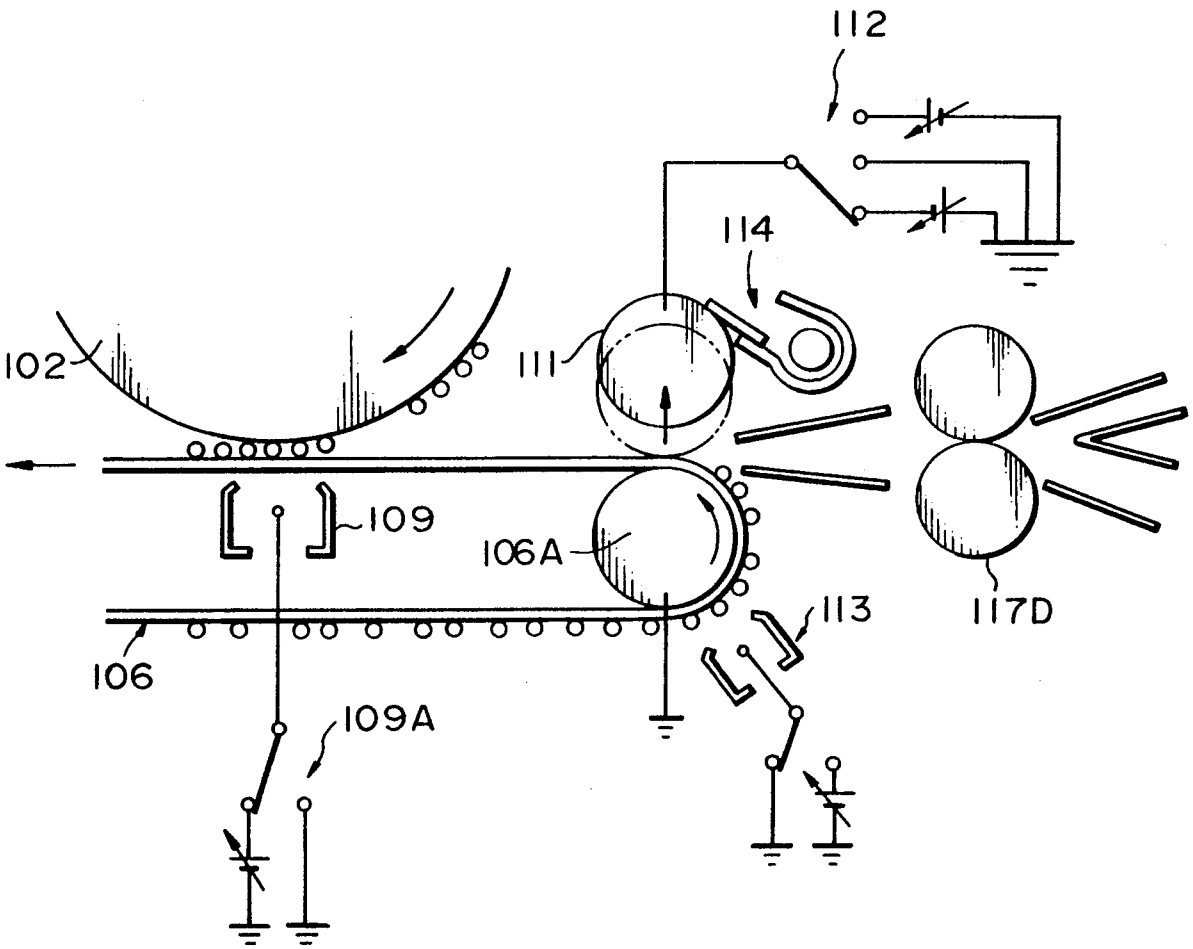
FIG. 14 is a view representative of the operation of the transfer means shown in FIG. 13.

FIG. 14 shows a process for transferring a toner image from the drum 102 to the paper sheet S directly. To implement this process, the primary toner image transfer device 109 operates with a polarity opposite to the polarity of the toner image formed on the drum 102, and all the bias rollers 111, 115 and charger 113 are maintained inoperative. The bias roller 111 is held in contact with the belt 106 so as to drive the paper sheet S in cooperation with the belt 106. When the toner image formed on the drum 102 by the developing device 105, i.e., by a developer of particular color is moved to a position where it faces the belt 106, the toner image is electrostatically transferred by the primary toner image transfer device 109 from the drum 102 to the paper sheet S having been fed from the paper feed mechanism in synchronism with the toner image. This mode corresponds to an ordinary single color copy mode and can be implemented by a construction similar to the conventional construction.

FIG. 14 shows a process for transferring the toner image or primary toner image from the drum 102 to the belt 106. The primary toner image transfer device 109 operates with a polarity opposite to the polarity of the primary toner image, and all the bias rollers 111, 115 and charge 113 are maintained inoperative, as in the procedure shown in FIG. 12. The paper feed mechanism 117 does not feed any paper sheet S. As a result, the primary toner image formed on the drum 102 is transferred to the belt 106 by the primary toner image transfer device 109.

Figure 15:
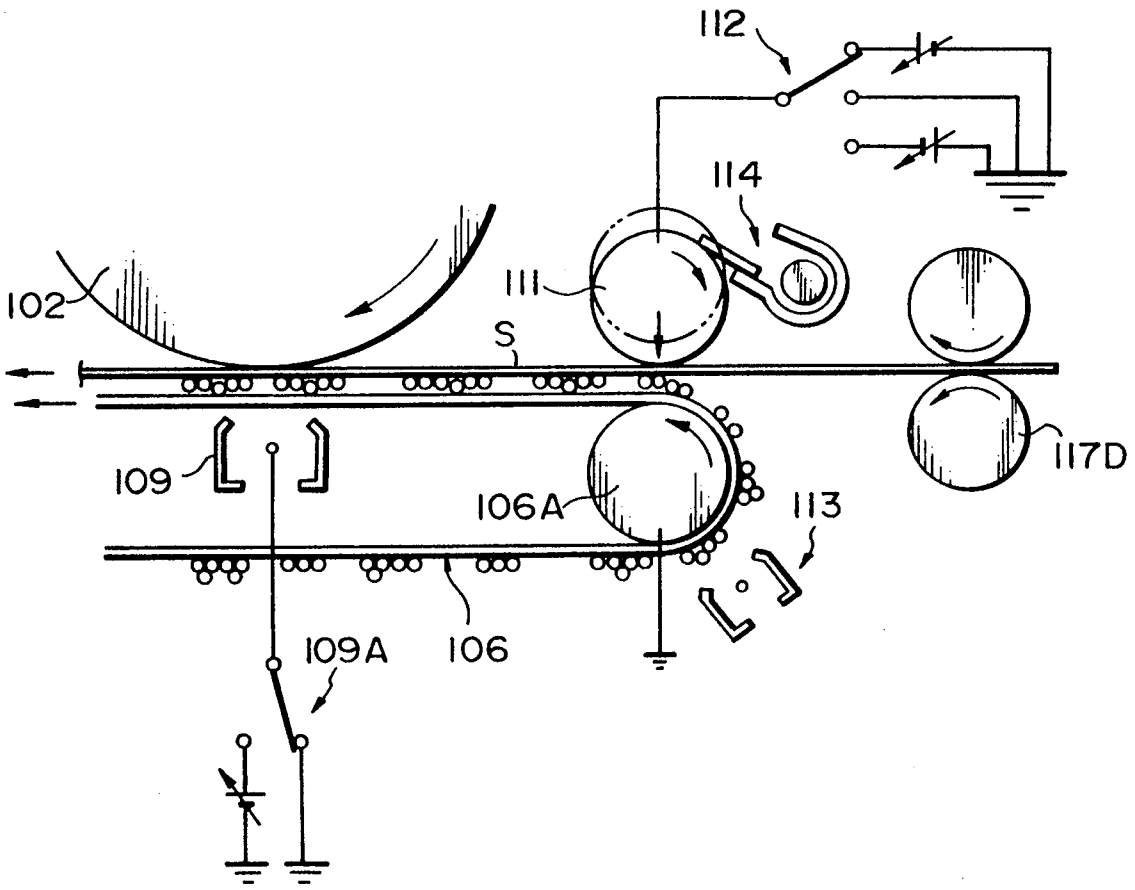
FIG. 15 is a view similar to FIG. 12, showing another specific construction of the transfer means shown in FIG. 11.

FIG. 15 shows a process for transferring the secondary toner image from the belt 106 to the paper sheet S. In this case, the primary toner image transfer device 109 and charger 113 do not function while the bias rollers 111 and 115 are each applied with a bias voltage opposite in polarity to the secondary toner image. In this condition, as the paper sheet is driven by the register roller 117D at a predetermining timing, the secondary toner is electrostatically transferred from the belt 106 to the paper sheet S by the bias roller 111. The bias roller 111 urges the toner image transferred by the bias roller 111 to the paper sheet S against the paper sheet S.

Figure 16:
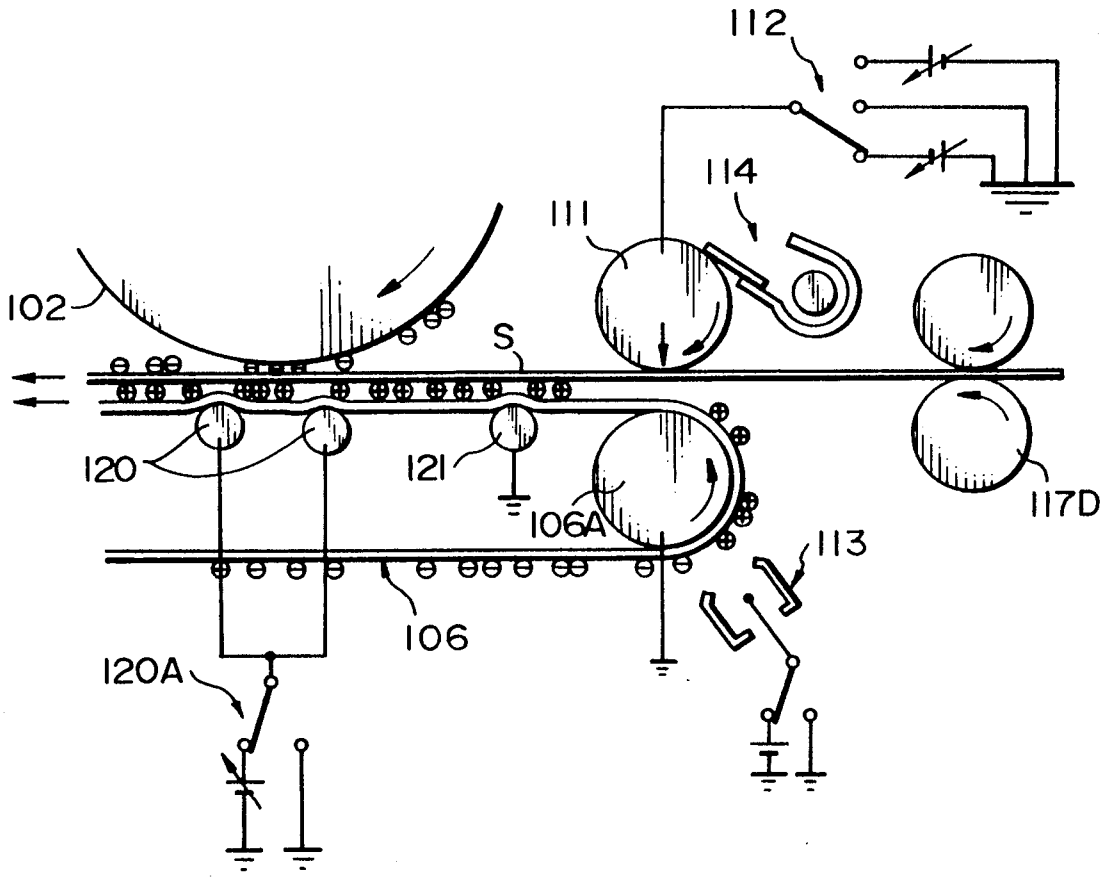
FIG. 16 is a view similar to FIG. 12, showing still another specific construction of the transfer means shown in FIG. 1.

Further, FIG. 16 shows a process for transferring a toner image to either side of the paper sheet S. To execute such a procedure, the primary toner image transfer device 109 is replaced with a pair of counter electrode rollers 120 which are connected to a bias circuit 120A and face the drum 102 with the intermediary of the belt 106. A counter electrode 121 for the transfer of the secondary toner image is interposed between the counter electrode roller 120 and the drive roller 106A and is implemented as a roller. In this modified arrangement, the primary toner image is transferred to the belt 106. Then, another primary toner image is formed on the drum 102. Subsequently, a paper sheet S is fed from the paper feed mechanism 117. As a result, the toner image or secondary toner image carried on the belt 106 and the second primary toner image formed on the drum 102 are transferred to opposite sides of the paper sheet S at the same time. With such a procedure, it is not necessary to turn over the paper sheet S.

In the event when the toner image formed on the drum 102 is to be first transferred to the belt 106, the counter electrode roller 120 operates with the a polarity opposite to the polarity of the toner image while the bias circuits connected to the bias roller 111, charger 113, bias roller 115 and roller 106B do not function. As a result, the toner image is transferred from the drum 102 to the belt 106 by the counter electrode roller 120. If desired, the primary toner image transfer device 109 shown in FIG. 12 may be substituted for the counter electrode roller 120.

After the second primary toner image has been formed on the drum 102, the bias rollers 111 and 115, FIG. 12, are moved toward the belt 106 to be capable of contacting the paper sheet S and charged to the opposite polarity to the secondary toner image carried on the belt 106. The charger 113 operates with a polarity opposite to the polarity of the secondary toner image transferred from the drum 102 to the belt 106 for the first time. The bias circuit 106E, FIG. 12, operates with the same polarity as the secondary toner image on the belt 102. In this condition, the secondary toner image carried on the belt 106 is moved toward the bias roller 111 with the polarity thereof reversed from negative to positive by the charger 113. As the paper sheet S is fed at an adequate timing, the secondary toner image is transferred from the belt 106 to the paper sheet S by the bias roller 111 while the primary toner image on the drum 102 is transferred to the paper sheet S by the charger 113. In this manner, toner images are transferred to either side of the paper sheet S. The bias roller 111 and the bias circuit 106E associated with the driven rolier 106B cooperate to urge the two toner images against opposite sides of the paper sheet S being driven toward the fixing device 118.

The fundamental concept underlying the procedures described above is taught in Japanese Patent Application No. 130466/1989.

In summary, the present invention having the above construction achieves various unprecedented advantages, as follows.

A corona transfer charger implementing intermediate transfer means reduces the pressure which acts on a photoconductive element in the event of image transfer. Hence, even when a carrier included in a developer and impurities such as paper dust are introduced in a transfer region, the photoconductive drum is free from damage and, therefore, durable and reliable while high quality images are insured. Secondary toner image transfer means in the form of a bias roller enhances efficient operations. This is especially true with the formation of a color image since the decrease in void discharge and the effective use of transfer pressure and electric field are promoted in regard to a laminate yellow, magenta, cyan and black toner image.

Since the bias roller urges a portion of a belt which intervenes between two counter electrode rollers, the belt and a paper sheet are deformed along the periphery of the bias roller. This extends the transfer region and thereby further enhances the transfer efficiency while insuring uniform image transfer.

The bias voltages applied to the bias roller and counter electrode rollers are adequately selected in matching relation to transfer conditions which depend on the copy mode, i.e., full-color copy mode, multicolor copy mode, or monochromatic copy mode. At the time of image transfer, the belt and bias roller retain a paper sheet therebetween to thereby prevent it from slipping off the belt even when some unexpected force is applied from the outside. As a result, an image is prevented from being dislocated, not transferred, or otherwise effected.

For the reasons described above, even a recording medium in the form of a limp, thin or waved paper can be surely transported to a fixing station without jamming the path.

Since image transfer and paper separation occur sequentially in the vicinity of a position where a paper sheet or similar recording medium should be separated from the belt, unusual discharge at the time of image transfer and, therefore, defective images are eliminated. Should the recording medium be separated from the belt on the elapse of a substantial period of time after image transfer, charge would undergo gaseous discharge among the belt, recording medium and toner. Then, the transfer efficiency would be lowered to cause defective image transfer to occur.

A bias roller is located at either side of a position where a toner image should be transferred from the photoconductive element to the belt with respect to the direction of paper transport. This allows an extra section for setting a bias to act on a paper sheet to be located at a position other than the transfer position, thereby extending the transfer bias setting range. Therefore, the transfer bias can be applied over a longer period of time to enhance electrostatic induction and, therefore, stable transfer conditions. As a result, not only efficient image transfer to a paper sheet is promoted, but also defective images such as a locally omitted image and a blurred or dislocated image are eliminated.

The bias roller located downstream of the transfer position prevents a paper sheet undergone image transfer from lifting at the leading edge thereof. This is also successful in introducing the paper sheet into the fixing device stably.

Various modifications will become possible for those skilled in the art after receiving the teachings of the present disclosure without departing from the scope thereof.

What is claimed is:

1. An image forming apparatus for forming an image on one or both sides of a recording medium, comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

intermediate transfer means for selectively transferring said primary toner image to the recording medium or transferring said primary toner image to said belt as a secondary toner image; and secondary toner image transfer means for transferring said secondary toner image to the recording medium;

said secondary toner image transfer means comprising bias roller means which is located in close proximity to an upper surface of said belt and downstream of a position where said belt directly faces said photoconductive element with respect to an intended direction of movement of said belt.

2. An image forming apparatus for forming an image on one or both sides of a recording medium, comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

intermediate transfer means for selectively transferring said primary toner image to the recording medium or transferring said primary toner image to said belt as a secondary toner image;

secondary toner image transfer means for transferring said secondary toner image to the recording medium;

said secondary toner image transfer means comprising bias roller means which is located in close proximity to an upper surface of said belt and downstream of a position where said belt directly faces said photoconductive element with respect to an intended direction of movement of said belt; and a plurality of counter electrodes facing said bias roller means with the intermediary of said belt and contacting inner periphery of said belt, and bias applying means for changing voltages to be applied to said bias roller means and said counter electrodes in matching relation to a record mode selected.

3. An image forming apparatus for forming an image on one or both sides of a recording medium, comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

intermediate transfer means for selectively transferring said primary toner image to the recording medium or transferring said primary toner image to said belt as a secondary toner image;

secondary toner image transfer means for transferring said secondary toner image to the recording medium;

said secondary toner image transfer means comprising bias roller means which is located in close proximity to an upper surface of said belt and downstream of a position where said belt directly faces said photoconductive element with respect to an intended direction of movement of said belt; and bias roller means located in close proximity to said upper surface of said belt and downstream of said intermediate transfer means with respect to said direction and movable into and out of contact with said belt.

4. An image forming apparatus for forming an image on one or both sides of a recording medium, comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

intermediate transfer means for selectively transferring said primary toner image to the recording medium or transferring said primary toner image to said belt as a secondary toner image;

secondary toner image transfer means for transferring said secondary toner image to the recording medium;

said secondary toner image transfer means comprising bias roller means which is located in close proximity to an upper surface of said belt and downstream of a position where said belt directly faces said photoconductive element with respect to an intended direction of movement of said belt; and a support roller located at a downstream side with respect to said direction for separating the recording medium from said belt, said bias roller means facing said support roller, and bias applying means associated with said support roller, said support roller functioning as a counter electrode coactive with said bias roller means.

5. An image forming apparatus comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

primary toner image transfer means for transferring said primary toner image to said belt or to a recording medium as a secondary toner image; and secondary toner image transfer means for transferring said secondary toner image from said belt to the recording medium;

said secondary toner image transfer means comprising bias roller means, said bias roller means comprising bias rollers located, respectively, upstream and downstream of said primary toner image transfer means with respect to an intended direction of movement of the recording medium.

6. An image forming apparatus comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

primary toner image transfer means for transferring said primary toner image to said belt or a recording medium as a secondary toner image;

secondary toner image transfer means for transferring said secondary toner image from said belt to the recording medium;

said secondary toner image transfer means comprising bias roller means, said bias roller means comprising bias rollers located, respectively, upstream and downstream of said primary toner image transfer means with respect to an intended direction of movement of the recording medium;

at least one counter electrode located to face said bias roller downstream of said primary toner image transfer means with the intermediary of said belt and contracting inner periphery of said belt; and bias applying means for changing voltages to be applied to said counter electrode and said bias roller downstream of said primary toner image transfer means in matching relation to a record mode.

7. An image forming apparatus comprising:
a rotatable photoconductive element;
optical writing means for electrostatically writing a latent image on said photoconductive element as a mirror image or a non-mirror image;
developing means for developing said latent image to produce a primary toner image;
an intermediate transfer body in the form of a belt located to face said photoconductive element;
primary toner transfer means for transferring said primary toner image to said belt or a recording medium as a secondary toner image; and
secondary toner image transfer means for transferring said secondary toner image from said belt to the recording medium, said secondary toner image transfer means comprising bias roller means, said bias roller means comprising bias rollers located, respectively, upstream and downstream of said primary toner image transfer means with respect to an intended direction of movement of the recording medium and said bias roller downstream of said primary toner image transfer means being movable into and out of contact with said belt.

8. An apparatus as claimed in claim 7, wherein said bias roller upstream of said primary toner image transfer means is movable into and out of contact with said belt in synchronism with said bias roller downstream of said primary toner image transfer means.

9. An image forming apparatus comprising:
a rotatable photoconductive element;
optical writing means for electrostatically writing a latent image on said photoconductive element as a mirror image or a non-mirror image;
developing means for developing said latent image to produce a primary toner image;
an intermediate transfer body in the form of a belt located to face said photoconductive element;
primary toner image transfer means for transferrinng said primary toner image to said belt or a recording medium as a secondary toner image;
secondary toner image transfer means for transferring said secondary toner image from said belt to the recording medium, said secondary toner image transfer means comprising bias roller means, said bias roller means comprising bias rollers located, respectively, upstream and downstream of said primary toner image transfer means with respect to an intended direction of movement of the recording medium;
a support roller located at a downstream side with respect to said direction for separating the recording medium from said belt, said bias roller means facing said support roller; and bias applying means associated with said support roller, said support roller functioning as a counter electrode coactive with said bias roller means.

10. An image forming apparatus for forming an image on one or both sides of a recording medium, comprising:
a rotatable photoconductive element;
optical writing means for electrostatically writing a latent image on said photoconductive element as a mirror image or a non-mirror image;
developing means for developing said latent image to produce a primary toner image;
an intermediate transfer body in the form of a belt located to face said photoconductive element;
intermediate transfer means for selectively transferring said primary toner image to the recording medium or transferring said primary toner image to said belt as a secondary toner image;
secondary toner image transfer means for transferring said secondary toner image to the recording medium, said secondary toner image transfer means comprising bias roller means which is located in close proximity to an upper surface of said belt and downstream of a position where said belt directly faces said photoconductive element with respect to an intended direction of movement of said belt; and
bias applying means for changing voltage to be applied to said bias roller means in matching relation to a selected record mode.

11. An apparatus as claimed in claim 10, further comprising:
at least one counter electrode facing said bias roller means with the intermediary of said belt and contacting inner periphery of said belt; and
second bias applying means for changing voltage to be applied to said counter electrode in matching relation to a record mode selected.

12. An apparatus as claimed in claim 11, further comprising moving means for moving said bias roller means into and out of contact with said belt in matching relation to a record mode selected.

13. An image forming apparatus for forming an image on one or both sides of a recording medium, comprising:
a rotatable photoconductive element;
optical writing means for electrostatically writing a latent image on said photoconductive element as a mirror image or a non-mirror image;
developing means for developing said latent image to roduce a primary toner image;
an intermediate transfer body in the form of a belt located to face said photoconductive element;
intermediate transfer means for selectively transferring said primary toner image to the recording medium or transferring said primary toner image to said belt as a secondary toner image;
secondary toner image transfer means for transferring said secondary toner image to the recording medium, said secondary toner image transfer means comprising bias roller means which is located in close proximity to an upper surface of said belt and downstream of a position where said belt directly faces said photoconductive element with respect to an intended direction of movement of said belt;
moving means for moving said bias roller means into contact with said belt while said secondary toner image is transferred to the recording medium; and
bias applying means for applying to said bias roller means bias voltage of an opposite polarity to said secondary toner image while said secondary toner image is transferred to the recording medium;
whereby said primary toner image is transferred from said intermediate transfer means to said recording medium, and said secondary toner image is transferred from said bias roller means to said recording medium.

14. An apparatus as claimed in claim 13, further comprising:
at least one counter electrode facing said bias roller means with the intermediary of said belt and contacting inner periphery of said belt; and second bias applying means for applying to said counter electrode bias voltage of the same polarity as said secondary toner image while said secondary toner image is transferred to said recording medium, wherein said secondary bias applying means does not apply said bias voltage to said counter electrode while said primary toner image is transferred to said recording medium.

15. An apparatus as claimed in claim 14, wherein said moving means moves said bias roller means out of contact with said belt while said primary toner image is transferred to said recording medium.

16. An apparatus as claimed in claim 13, further comprising charging means located upstream of a position where said recording medium is supplied to said belt and downstream of said bias roller means with respect to the intended direction of movement of said belt for changing the polarity of said secondary toner image, wherein said charging means changes the polarity of said secondary toner image on said belt to the opposite polarity when said primary and secondary toner images are transferred to both sides of said recording medium.

17. An image forming apparatus comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

primary toner image transfer means for transferring said primary toner image to said belt or to a recording medium as a secondary toner image; and secondary toner image transfer means for transferring said secondary toner image from said belt to the recording medium, said secondary toner image transfer means comprising first bias roller means located upstream of said photoconductive element with respect to an intended direction of movement of said belt and first bias applying means for changing voltage to be applied to said first bias roller means in matching relation to a selected record mode.

18. An apparatus as claimed in claim 17, further comprising first moving means for moving said first bias roller means into and out of contact with said belt in matching relation to a selected record mode.

19. An apparatus as claimed in claim 18, wherein said secondary toner image transfer means further comprises second bias roller means located downstream of said photoconductive element with respect to the intended direction of movement of said belt and second applying means for changing voltage to be applied to said second bias roller means in matching relation to a selected record mode.

20. An apparatus as claimed in claim 19, further comprising second moving means for moving said second bias roller means into and out of contact with said belt in matching relation to a record mode selected.

21. An apparatus as claimed in claim 20, further comprising:

at least one counter electrode located to face said second bias roller means with the intermediary of said belt and contacting inner periphery of said belt; and third bias applying means for changing voltage to be applied to said counter electrode in matching relation to a record mode selected.

22. An image forming apparatus, comprising:

a rotatable photoconductive element;

optical writing means for electrostatically writing a latent image on said photoconductive element as a mirror image or a non-mirror image;

developing means for developing said latent image to produce a primary toner image;

an intermediate transfer body in the form of a belt located to face said photoconductive element;

primary toner image transfer means for transferring said primary toner image to said belt or to a recording medium as a secondary toner image;

secondary toner image transfer means for transferring said secondary toner image from said belt to the recording medium, said secondary toner image transfer means comprising first bias roller means located upstream of said photoconductive element with respect to an intended direction of movement of said belt and first bias applying means for applying to said first bias roller means bias voltage of an opposite polarity to said secondary toner image while said secondary toner image is transferred to said recording medium, wherein said first bias applying means does not apply said bias voltage to said first bias roller means while said primary toner image is transferred to said recording medium; and first moving means for moving said first bias roller means into contact with said belt while said secondary toner image is transferred to said recording medium.

23. An apparatus as claimed in claim 22, wherein said secondary toner image transfer means further comprises second bias roller means located downstream of said photoconductive element with respect to the intended direction of movement of said belt and second bias applying means for applying to said second bias roller means bias voltage of an opposite polarity to said secondary toner image while said secondary toner image is transferred to said recording medium, wherein said second bias applying means does not apply said bias voltage to said second bias roller means while said primary toner image is transferred to said recording medium.

24. An apparatus as claimed in claim 23, further comprising second moving means for moving said second bias roller means into contact with said belt while said secondary toner image is transferred to said recording medium.

25. An apparatus as claimed in claim 24, further comprising:

at least one counter electrode located to face said second bias roller means with the intermediary of said belt and contacting inner periphery of said belt; and third bias applying means for applying to said counter electrode bias voltage of an opposite polarity to the polarity of said bias voltage applied by said second bias applying means.

26. An apparatus as claimed in claim 24, wherein said first and second bias roller means are moved by said first and second moving means, respectively, out of contact with said belt while said primary toner image is transferred to said recording medium.

27. An apparatus as claimed in claim 22, further comprising charging means located upstream of said first bias roller means and downstream of said second bias roller means with respect to the intended direction of movement of said belt for changing the polarity of said secondary toner image, wherein said charging means charges the polarity of said secondary toner image on said belt to the opposite polarity when said primary and secondary toner images are transferred to both sides of said recording medium.

* * * * *